US005263885A

United States Patent [19]

Montague

[11] Patent Number: 5,263,885

[45] Date of Patent: Nov. 23, 1993

[54] ELECTRONIC WINTERIZER

[75] Inventor: Michael J. Montague, Box 4521, Batesville, Ark. 72503

[73] Assignee: Michael J. Montague, Batesville, Ark.

[21] Appl. No.: 993,641

[22] Filed: Dec. 21, 1992

[51] Int. Cl.[5] ..... B63H 21/38

[52] U.S. Cl. ..... 440/88; 440/900

[58] Field of Search ..... 440/88, 113, 900

[56] References Cited

U.S. PATENT DOCUMENTS

| | | | |
|---|---|---|---|
| 3,550,612 | 7/1968 | Maxon | 440/88 X |
| 4,121,948 | 10/1978 | Guhlin | 440/88 X |
| 4,619,618 | 10/1986 | Patti | 440/88 |
| 4,857,023 | 8/1989 | Takashima | 440/88 |

*Primary Examiner*—Sherman D. Basinger

[57] ABSTRACT

The electronic winterizer is a device that is installed in the interior of a boat. It winterizes an inboard/outboard engine without the use of a person knowledgeable of this process. It can be accomplished in or out of the water. The invention allows a boat owner to operate his inboard/outboard engine in cold temperatures without having to employ a person to winterize the engine each time he uses it. Thus it is made useful all winter. To operate, the inboard/outboard engine is first started. After the engine reaches an acceptable temperature, the thermostat is opened. While the engine is running the operator turns on a switch that is mounted in the dash of the driver's console. The switch activates an electronic timer that operates a DC powered valve and pump. At the time of operation the valve opens and the pump starts. The pump drains antifreeze from a holding tank that is also installed in the boat's interior. The pump dispenses antifreeze through the open valve and into the injector. The injector is mounted in the hose that provides coolant to the engine and outdrive. The antifreeze passes through the injector at such an angle that it mixes the antifreeze and water coolant to a ratio acceptable to prevent the unit from freezing.

3 Claims, 2 Drawing Sheets

ELECTRONIC WINTERIZER

BRIEF DISCRIPTION OF THE INVENTION

In the past, marine engine's coolant system had to be drained in cold temperatures to avoid freezing and damaging the engine's block, manifolds, and outdrive housing. This was done manually by removing pet cocks mounted throughout the system, thus enabling the system to drain water coolant. The operation is known as winterizing.

This invention winterizes an inboard/outboard engine and outdrive by methods of: electronically injecting a premeasured amount of antifreeze into the engine's coolant system. It is achieved from the continents of the boats interior. Thus making it new, permanent, and totally self contained.

DETAILED DESCRIPTION

Figure 1:
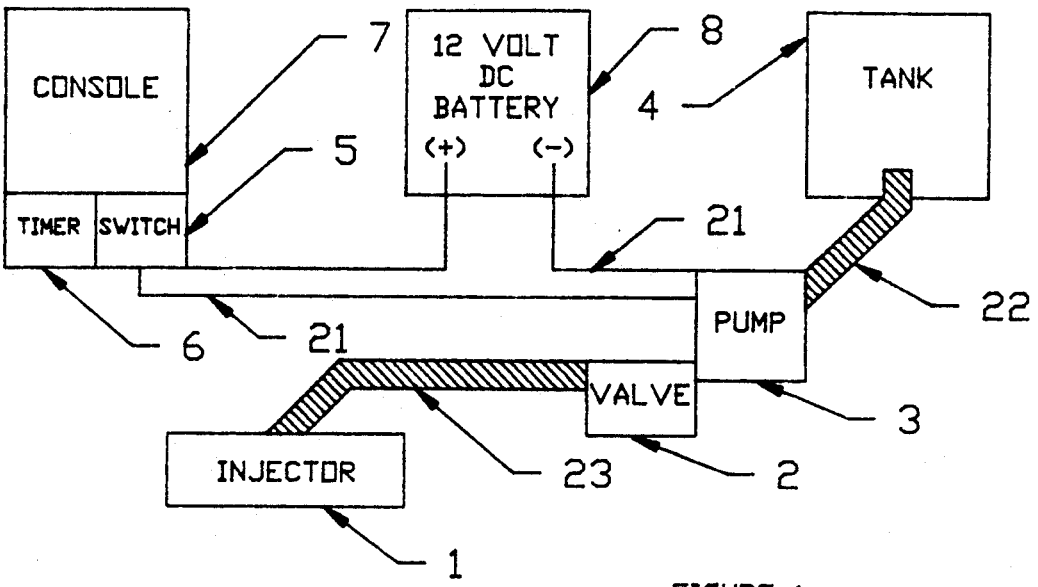
FIG. 1 is a side view of the first embodiment of the electronic winterizer.

Referring to the drawing, the present invention is an electronic winterizer kit. It is applied to a inboard/outboard marine engine's operational system. The preferred embodiment allows a marine engine to be winterized by persons not familiar with the process. It is new over what is old by injecting antifreeze into the coolant system, as opposed of draining engine's coolant system. The kit consists of: injector 1, valve 2, pump 3, tank 4, rocker switch 5, timer 6, wire harness 21, and plastic tubing 22, as shown in FIG. 1.

Figure 3:
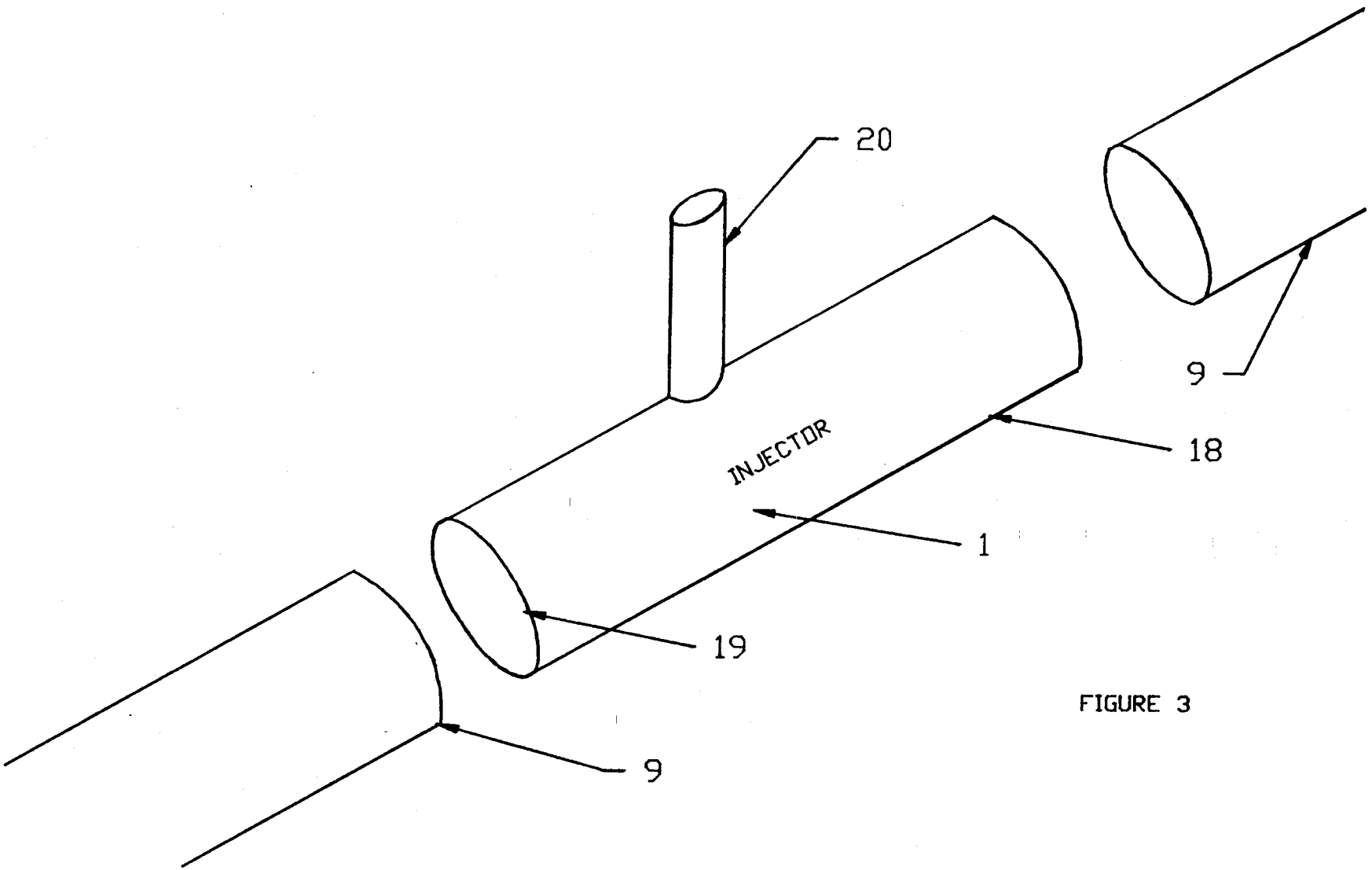
FIG. 3 is a side view of the second embodiment of the injector which is a part of FIGS. 1 and 2.

The first step is to install injector 1 into the hose 9 that provides coolant, between intermediate housing 14 and engine thermostat 10, as in FIG. 3.

Figure 2:
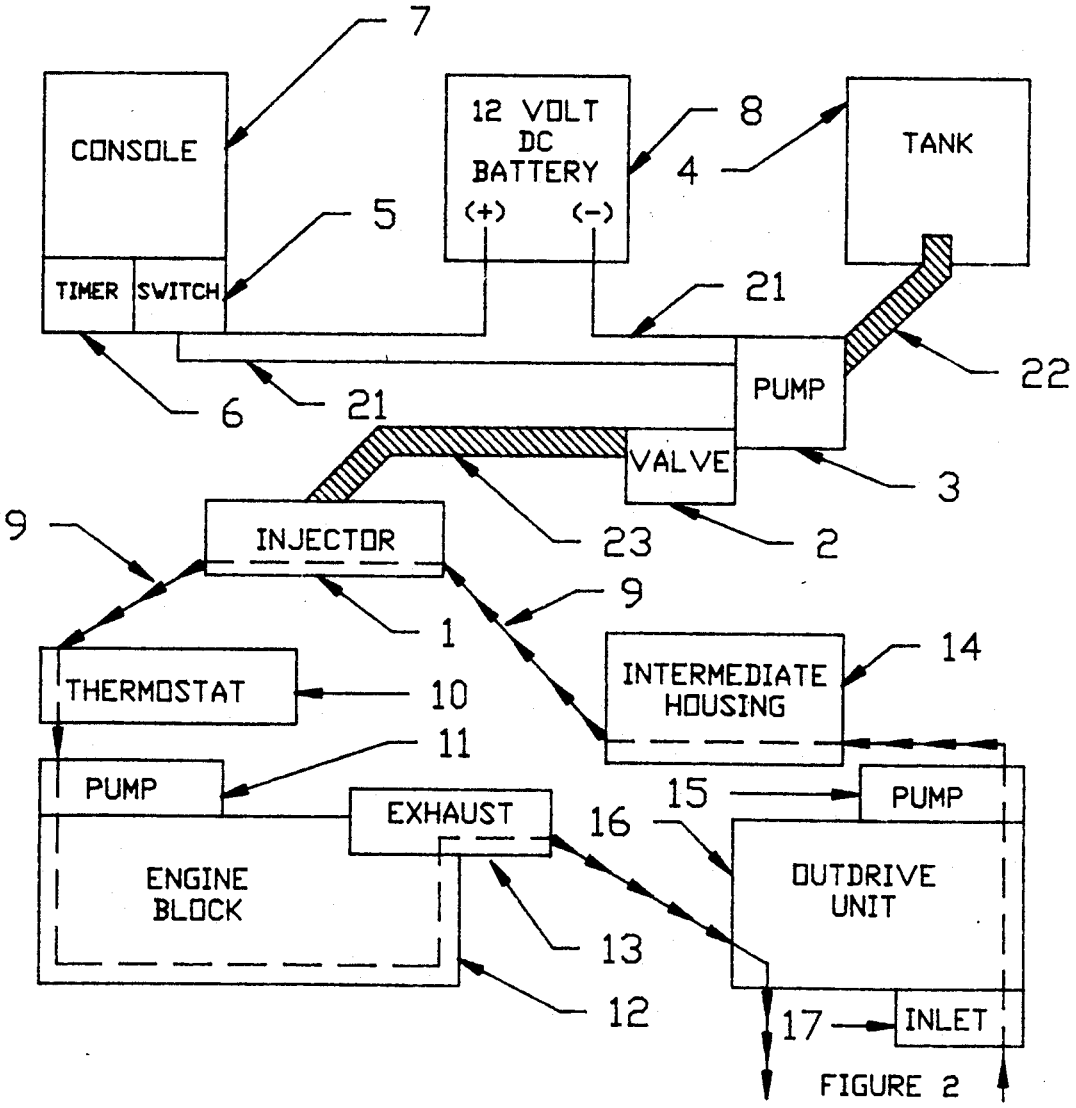
FIG. 2 is a diagram illustrating the electronic winterizer in operation.

The second step is to secure valve 2, pump 3, and tank 4 to the floor of engine 12 compartment, connect hose from tank 4 to the pump 3 and valve 2, and connect hose from valve 2 to injector 1, as in FIGS. 1 and 2.

The third step is to install timer 6, switch 5 into the driver's console 7, and run wiring harness 21 to pump 3 and valve 2 as in FIGS. 1 and 2.

The fourth step is to fill holding tank 4 with antifreeze. Electronic winterizer is installed.

The operation mode consists of this: operator starts engine 12, the engine's driveshaft operates pump 15 mounted on outdrive unit 16. The pump 15 pulls water coolant from outdrive inlet 17 thru outdrive unit 16, pump 15, intermediate housing 14, injector 1, water coolant hose 9 and stops at thermostat 10. When engine 12 reaches a sufficient temperature, the thermostat 10 will open and allow engine pump 11 to pull coolant into engine block 12, coolant then exits thru exhaust 13, outdrive unit 16 and out of boat as in FIG. 2. When thermostat 10 opens, operator turns electronic winterizer on. The switch 5 activated timer 6 and allows pump 3 to operate for 30 seconds. Which pump 3 dispenses 1½ gallons of antifreeze from tank 4 thru hose 22, thru pump 3, thru valve 2, thru hose 23, thru injector 1, and into engine's water coolant hose 9. The engine's pump 11 pulls antifreeze and water coolant thru thermostat 10, engine's pump 11 and into the engine's block 12. The mixture of coolant and antifreeze then exits through exhaust 13, outdrive unit 16, and out of boat as in FIG. 2. When pump 3 stops operator turns engine 12 off. The operation is now completed. The inboard/outboard engine is protected from freezing.

The following statement applies to FIG. 3. The injector consists of any material that can be manufactured to handle high degree of water temperature. It is inserted in the engine's coolant hose 9 as in FIG. 2. It has an inlet opening 18, and an outlet opening 19. The injector tube 20 comes in contact with the inlet opening 18 and outlet opening 19 at a 45 degree angle so as to insure an acceptable ratio of antifreeze vs. water coolant. A 90 degree angle on the injector tube 20 is not acceptable. This instant invention has been shown and described herein, in what is considered to be the most practical and preferred embodiment. It recognized, however, that departures may be made therefrom within the scope of the invention and that obvious modifications will occur to a person skilled in the art.

What is claimed is:

1. A powered electronic winterizer kit for use as an alternative method of preparing a coolant system for a marine inboard/outboard engine for cold weather; said kit comprising:

an electric switch mounted to a driver's console;

an electric timer mounted to said switch;

a wiring harness connecting said switch to a pump and a valve;

a holding tank for antifreeze;

an injector mounted in the coolant system for said inboard/outboard engine, said injector controlling the ratio at which antifreeze is distributed to water coolant in the coolant system;

a plurality of hoses connecting the holding tank to said pump, to said valve, and to said injector; and wherein said switch activates said timer to operate said pump and valve for a predetermined period of time, said pump during the predetermined period of time dispensing antifreeze from said tank to said injector and into the coolant system for said engine.

2. The kit of claim 1 wherein the coolant system of said marine inboard/outboard engine comprises an intermediate housing, a thermostat, and a hose between said intermediate housing and said thermostat, said injector being installed into said hose.

3. The kit of claim 2 wherein said injector comprises a larger tube having an inlet opening and an outlet opening, and a smaller tube located between said inlet opening and said outlet opening and forming an angle of 45° with said larger tube so as to mix the antifreeze with the water coolant at an acceptable rate.

* * * * *